United States Patent [19]

Fukutome et al.

[11] Patent Number: 4,482,257

[45] Date of Patent: Nov. 13, 1984

[54] ACOUSTIC ALARM DEVICE FOR WATCHES

[75] Inventors: Satoru Fukutome; Hideo Hatanaka; Motoyuki Saito, all of Tanashi, Japan

[73] Assignee: Citizen Watch Co., Ltd., Tokyo, Japan

[21] Appl. No.: 392,636

[22] Filed: Jun. 28, 1982

Related U.S. Application Data

[62] Division of Ser. No. 164,769, Jun. 30, 1980, Pat. No. 4,351,041.

[30] Foreign Application Priority Data

| | | | |
|---|---|---|---|
| Jun. 30, 1979 | [JP] | Japan | 54-89820 |
| Jun. 30, 1979 | [JP] | Japan | 54-89821 |
| Jun. 30, 1979 | [JP] | Japan | 54-89822 |

[51] Int. Cl.[3] ..... G04C 23/02; G04C 21/16

[52] U.S. Cl. ..... 368/88; 368/250

[58] Field of Search ..... 368/72–74, 368/250–251, 255; 340/384 E, 387, 388

[56] References Cited

U.S. PATENT DOCUMENTS

| | | | |
|---|---|---|---|
| 3,777,472 | 12/1973 | Iinuma | 368/255 |
| 3,879,931 | 4/1975 | Yasuda et al. | 368/255 |
| 3,906,713 | 9/1975 | Suda et al. | 368/255 |
| 4,197,697 | 4/1980 | Mori et al. | 368/315 |
| 4,206,590 | 6/1980 | Fukutome et al. | 368/72 |
| 4,250,573 | 2/1981 | Saito | 340/387 X |

FOREIGN PATENT DOCUMENTS

| | | | |
|---|---|---|---|
| 52-58959 | 5/1977 | Japan | 368/250 |
| 52-75376 | 6/1977 | Japan | 368/250 |

*Primary Examiner*—Vit W. Miska

*Attorney, Agent, or Firm*—Birch, Stewart, Kolasch & Birch

[57] ABSTRACT

An alarm device for a watch mounted in a recess provided in an upper portion of the watch case, for example in the upper portion of the band connecting portion of the watch case. The alarm device comprises a vibration plate secured to the bottom of the recess, a watertight sealing member, a cover for the vibration plate and securing means such as a screw for fixing the vibration plate to the recess through the watertight sealing member.

3 Claims, 6 Drawing Figures

ACOUSTIC ALARM DEVICE FOR WATCHES

This application is a divisional of copending application Ser. No. 164,769, filed on June 30, 1980, now U.S. Pat. No. 4,351,041.

BACKGROUND OF THE INVENTION

The present invention relates to an acoustic alarm device for watches.

It is desirable for miniaturizing a watch to provide the acoustic alarm device in an upper portion of the watch case which is not used for the watch movement or module, such as a band connecting portion of the watch case. However, the thickness of the alarm device must be decreased so as to be mounted in a thin portion of the watch case and moreover watertight means must be provided. Further, the alarm device must be constructed to be inserted into the watch case from the upper side thereof.

SUMMARY OF THE INVENTION

An object of the present invention is to provide a compact alarm device having perfect watertightness. Another object of the present invention is to provide an alarm device which may be mounted on a watch case.

Other objects will become more apparent from the following description with reference to the accompanying drawings.

BRIEF DESCRIPTION OF THE DRAWINGS

FIG. 2 is a sectional view taken along the line 3—3 of FIG. 1;

DESCRIPTION OF PREFERRED EMBODIMENTS

Figure 1:
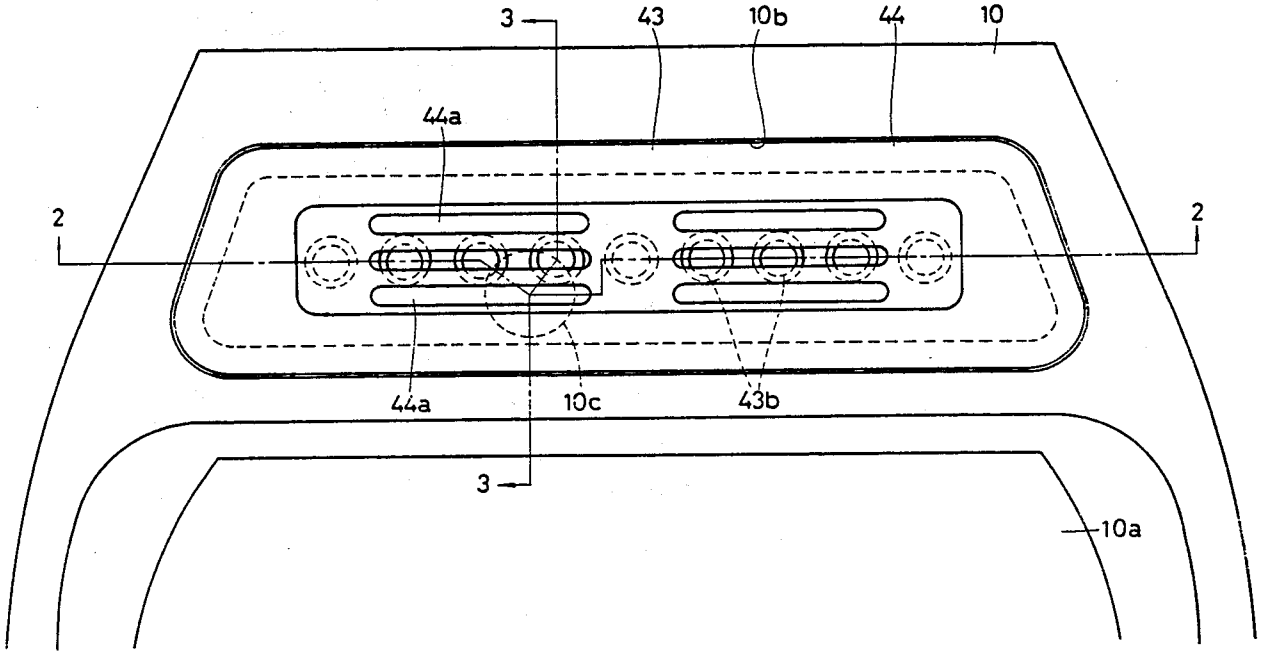
FIG. 1 is a front view of an acoustic alarm device of the present invention.
Figure 2:
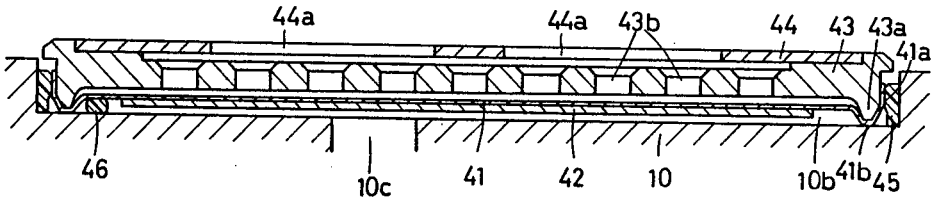
FIG. 2 is a sectional view taken along the line 2—2 of FIG. 1.
Figure 3:
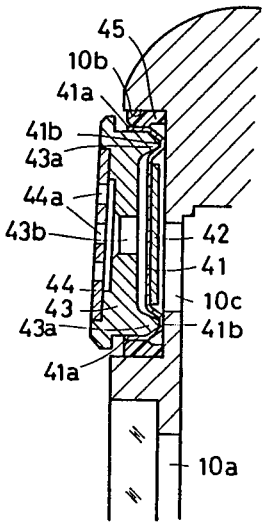
Figure 4:
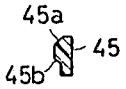
FIG. 4 is a sectional view of a packing.

Referring to FIGS. 1 to 4, numeral 10 designates a watch case having a module (not shown) therein and a display portion 10*a* on an upper portion thereof. In an upper portion of a band-connecting portion of the watch case, an oblong recess 10*b* is provided for mounting an alarm device. A communication hole 10*c* is provided in the bottom of the recess 10*b* for electrical connection between the module in the watch case 10 and the alarm device in the recess.

A vibration plate 41 has a piezoelectric element 42 securely fixed to the underside thereof. Numeral 43 designates, a cover 43, and 44 is an ornament plate. The vibration plate 41 has a peripheral upright portion 41*a* and a downwardly projected portion 41*b* adjacent the inside of the upright porton 41*a*. The cover 43 has a peripheral leg portion 43*a* engageable with the inside of the projected portion 41*b* of the vibration plate 41 and has a plurality of sound emanating holes 43*b*. The ornament plate 44 also has a plurality of sound emanating holes 44*a* communicating with the holes 43*b* of the cover 43. An annular packing 45 is disposed between the inner side wall of the recess 10*b* and the upright portion 41*a* of the vibration plate 41. The packing 45 has an inner diameter slighly smaller than the upright portion 41*a* and has an upper inside beveled portion 45*a* and lower escape portion 45*b*. An electric conduction ball member 46 made of elastic material such as rubber is disposed between the vibration plate 41 and the bottom of the recess 10*b* for grounding the vibration plate.

When the device is assembled, the vibration plate 41 and the cover 43 are integrated with each other by the engagement between the projected portion 41*b* and the leg portion 43*a*. The packing 45 is engaged with the recess 10*b* of the watch case 10 and the electric conduction ball member 46 is disposed on a suitable position of the bottom of the recess 10*b*. Then, the assembled vibration plate is engaged with the recess 10*b* with pressing against the packing 45. Thus, the vibration plate 41 is secured to the watch case 10 with a watertight sealing. The packing 45 having the escape portion 45*b* acts to urge the vibration plate 41 and cover 43 toward the bottom of the recess. Thus, the vibration plate and cover may be securely held in the recess without rising.

Figure 5:
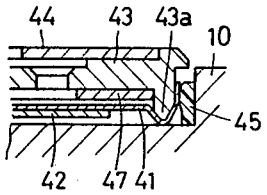
FIG. 5 is a sectional view showing a principal part of a second embodiment of the present invention.

In the second embodiment shown in FIG. 5, the cover 43 is made of plastics. The leg portion 43*a* of plastics is liable to be bent inwardly by the restitution force of the packing 45 to thereby decrease watertight effect. In order to prevent the bending of the leg portion 43*a* and to ensure the watertight, a reinforcement member 47 is engaged with the inside of the leg portion.

Figure 6:
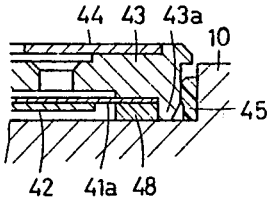
FIG. 6 is a sectional view showing a principal part of a third embodiment of the present invention.

The third embodiment of the present invention shown in FIG. 6 is similar to the second embodiment in construction having a reinforcement member 48. However, the vibration plate 41*a* is a flat plate and secured to the underside of the cover 43 with adhesives. The reinforcement member 48 is engaged with the vibration plate 41*a* and the inside of the leg portion 43*a* to maintain the vibration plate. The cover 43 engages directly with the packing 45 to be held in the recess 10*b* of the watch case.

From the foregoing it will be understood that the present invention provides an acoustic alarm device which may be made into a small size with a watertight sealing and mounted on the upper portion of the watch case such as a band connecting portion. Thus, the space in the watch case may be effectively used so as to reduce the size of the watch.

What is claimed is:

1. An alarm device for a watch having a watch case, comprising a recess provided in an upper portion of the body of said watch case, a watertight sealing member provided in said recess, a vibration plate engaged with said watertight sealing member, a cover for said vibration plate, said cover having sound emanating holes and a leg portion provided on the periphery thereof, said watertight sealing member disposed between said leg portion and the inner wall of said recess, and means for frictionally securing said vibration plate, cover and watertight sealing member by flat surface frictional contact between said leg portion and said watertight sealing member and the wall of said recess.

2. The alarm device according to claim 1 wherein said vibration plate has a peripheral upright portion engaged between the outside of said leg portion and said watertight sealing member.

3. The alarm device according to claim 1 further comprising a reinforcement member disposed inside said leg portion for preventing the inward bending of the leg portion.

* * * * *